United States Patent [19]

Shinomiya et al.

[11] Patent Number: 4,506,577

[45] Date of Patent: Mar. 26, 1985

[54] SLITTER APPARATUS

[75] Inventors: Tsutomu Shinomiya; Shigeki Mori, both of Sapporo; Hiroshi Higuchi, Nagareyama, all of Japan

[73] Assignee: Hokkai Can Co., Ltd., Tokyo, Japan

[21] Appl. No.: 532,568

[22] Filed: Sep. 15, 1983

[30] Foreign Application Priority Data

Sep. 16, 1982 [JP] Japan ..... 57-138921[U]

[51] Int. Cl.[3] ..... B26D 1/24; B26D 7/26

[52] U.S. Cl. ..... 83/499; 83/500; 83/501; 83/564

[58] Field of Search ..... 83/499, 501, 500, 498, 83/495, 502, 503, 504, 564

[56] References Cited

U.S. PATENT DOCUMENTS

| | | | |
|---|---|---|---|
| 3,041,907 | 7/1962 | Gallagher | 83/564 X |
| 3,185,010 | 5/1965 | Printz et al. | 83/501 X |
| 3,186,281 | 6/1965 | Wingen | 83/501 X |
| 3,376,774 | 4/1968 | Collins | 83/499 X |

FOREIGN PATENT DOCUMENTS

| | | | |
|---|---|---|---|
| 483107 | 10/1929 | Fed. Rep. of Germany | 83/499 |
| 2931970 | 2/1981 | Fed. Rep. of Germany | 83/499 |

*Primary Examiner*—Donald R. Schran

*Attorney, Agent, or Firm*—Birch, Stewart, Kolasch & Birch

[57] ABSTRACT

A slitter apparatus for slitting a sheet member such as a corrugated cardboard or the like into predetermined widths. At least one pair of upper and lower rotary cutters and at least one pair of upper and lower shifters corresponding thereto being disposed above and below a conveying passage for the sheet member. The pair of upper and lower shifters being operatively arranged to be moved slidably along on respective guide rods by respective feeding screws. The pair of upper and lower rotary cutters being selectively imparted with a predetermined shift movement. At least one of the upper and lower rotary cutters being rotatably supported on one end portion of a supporting arm, and the other end portion of the supporting arm being in threaded engagement with a screw rod provided in parallel with the guide rods so that the supporting arm may be swingable about the screw rod and also may be movable along the axial direction of the turning screw rod. A first driving member is operatively mounted for swinging the supporting arm and a second driving member is operatively mounted for turning the screw rod.

3 Claims, 3 Drawing Figures

SLITTER APPARATUS

BACKGROUND OF THE INVENTION

1. Field of the Invention

This invention relates to a slitter apparatus for slitting a sheet member, such as a corrugated cardboard or the like, into predetermined widths. At least one pair of upper and lower rotary cutters are disposed above and below a conveying passage for the sheet member so as to be movable in a lateral direction relative to the passage of the sheet member by means of respective shifters. An arrangement is provided wherein the pair of upper and lower rotary cutters are simply and easily adjustable so as to obtain a proper lateral gap therebetween.

2. Description of Background Art

Hithertofore, apparatus were available for slitting a sheet member, such as a corrugated cardboard or the like, into predetermined widths. At least one pair of upper and lower rotary cutters and at least one pair of upper and lower shifters corresponding thereto are disposed above and below a conveying passage for the sheet member. The pair of upper and lower shifters are arranged to be slidably movable along respective guide rods by means of respective feeding screws so that the pair of upper and lower rotary cutters may be imparted with predetermined shift movements. During the shift movements, the upper and lower rotary cutters, which are positioned in a laterally overlapped relationship, are at once separated open relative to each other in the vertical direction. However, generally during manufacturing of the upper and lower feeding threaded rods, sometimes errors occur in threaded pitches thereof.

Therefore, it is usual with a conventional apparatus that when the upper and lower rotary cutters are moved by the threaded rods to predetermined positions, often a predetermined shearing gap between the two rotary cutters cannot be obtained without being finely adjusted thereafter. To accomplish a fine adjustment with the conventional apparatus, either one of the shifters is slightly moved manually, that is, by being tapped by a hammer until a predetermined shearing gap between the two rotary cutters is obtained. Consequently, it is difficult to obtain a predetermined shearing gap easily and the fine adjustment work is very troublesome.

SUMMARY AND OBJECTS OF THE INVENTION

This invention has for its object to provide an apparatus free from the inconvenience of the conventional apparatus. An apparatus for slitting a sheet member, such as a corrugated cardboard or the like, into predetermined widths is provided including at least one pair of upper and lower rotary cutters. At least one pair of upper and lower shifters corresponding thereto are disposed above and below a conveying passage for the sheet member. The pair of upper and lower shifters are arranged to be moved slidably along on respective guide rods by means of respective feeding screws so that the pair of upper and lower rotary cutters may be given predetermined shift movements. At least one of the upper and lower rotary cutters is rotatably supported on one end portion of a supporting arm, and the other end portion of the supporting arm is in threaded engagement with a screw rod provided in parallel with the guide rods so that the supporting arm may be swingable about the screw rod and also may be movable along the axial direction of the turning screw rod. A first driving means is provided for swinging the supporting arm and a second driving means is provided for turning the screw rod.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
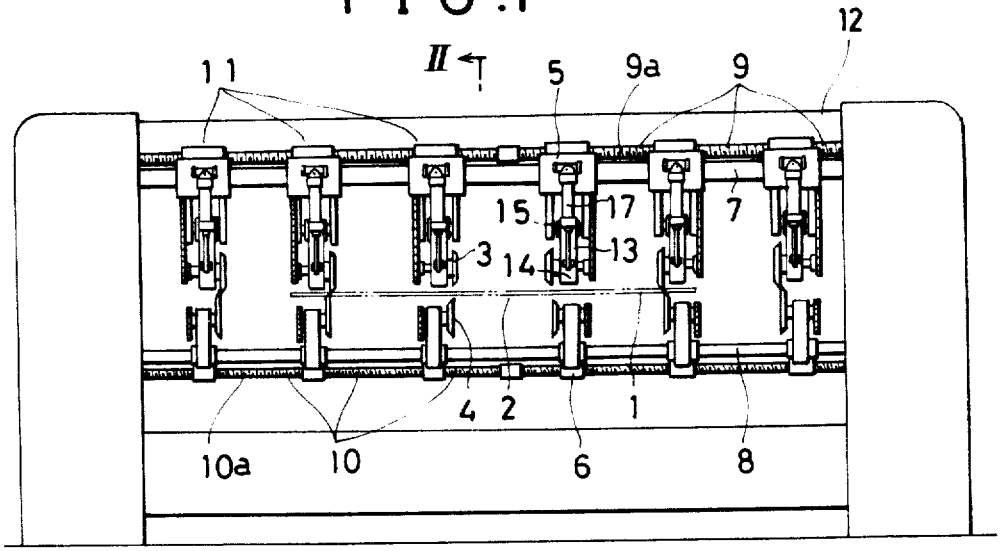
FIG. 1 is a front view of one embodying example of the present invention.

Referring to the drawings, a sheet member 1, such as a corrugated cardboard or the like, is supplied along a conveying passage 2 in order to slit the sheet member 1 into predetermined widths. At least one pair of upper and lower rotary cutters 3, 4 and at least one pair of upper and lower shifters 5, 6 corresponding thereto are disposed above and below the conveying passage 2. The pair of upper and lower shifters 5, 6 are arranged to be slidably moved along on respective pairs of guide rods 7, 7 and 8, 8 by means of a pair of upper and lower feeding screws 9 and 10, so that the pair of upper and lower rotary cutters 3, 4 may be given predetermined shift movements through the respective shifters 5, 6.

In the illustrated example, as shown clearly in FIG. 1, the pair of upper and lower rotary cutters 3, 4 and the pair of upper and lower shifters 5, 6 constitute a single assembly 11. Six assemblies thereof 11, 11, . . . are provided on a machine frame 12 in such a manner that three assemblies 11, 11, 11 are disposed on the left side and the remainder three 11, 11, 11 are disposed on the right side, as shown in FIG. 1.

In this orientation, the foregoing feeding screws 9, 10 comprise a pair of upper and lower feeding screws 9*a*, 10*a* for the left side assemblies 11, 11, 11 and another pair of upper and lower feeding screws 9*b*, 10*b* for the right side assemblies 11, 11, 11. More in detail, as shown clearly in FIG. 2, the feeding screws 9*a*, 10*a* are in threaded engagement with the respective shifters 5, 6 of the left side assemblies 11, 11, 11 but the feeding screws 9*b*, 10*b* are not in threaded engagement therewith. Thus, the feeding screws 9*a*, 10*a* may serve to move only the left side assemblies 11, 11, 11. In reverse thereto, the feeding screws 9*b*, 10*b* are in threaded engagement only with the right side assemblies 11, 11, 11 so that only these three assemblies 11, 11, 11 may be moved by the rotations thereof.

Figure 3:
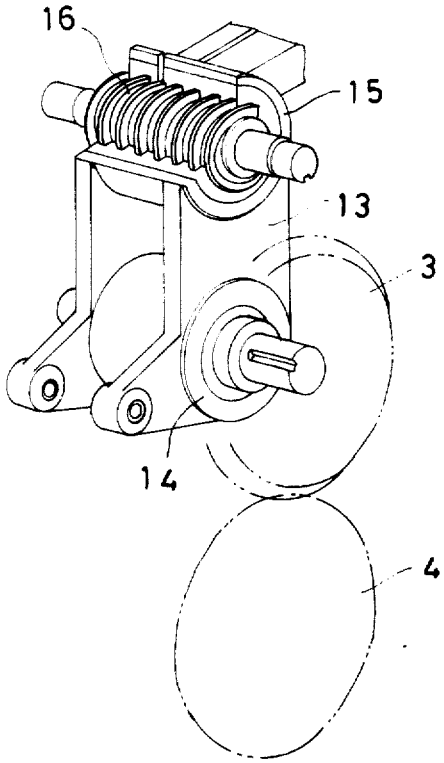
FIG. 3 is a perspective view of an important part thereof.
Figure 2:
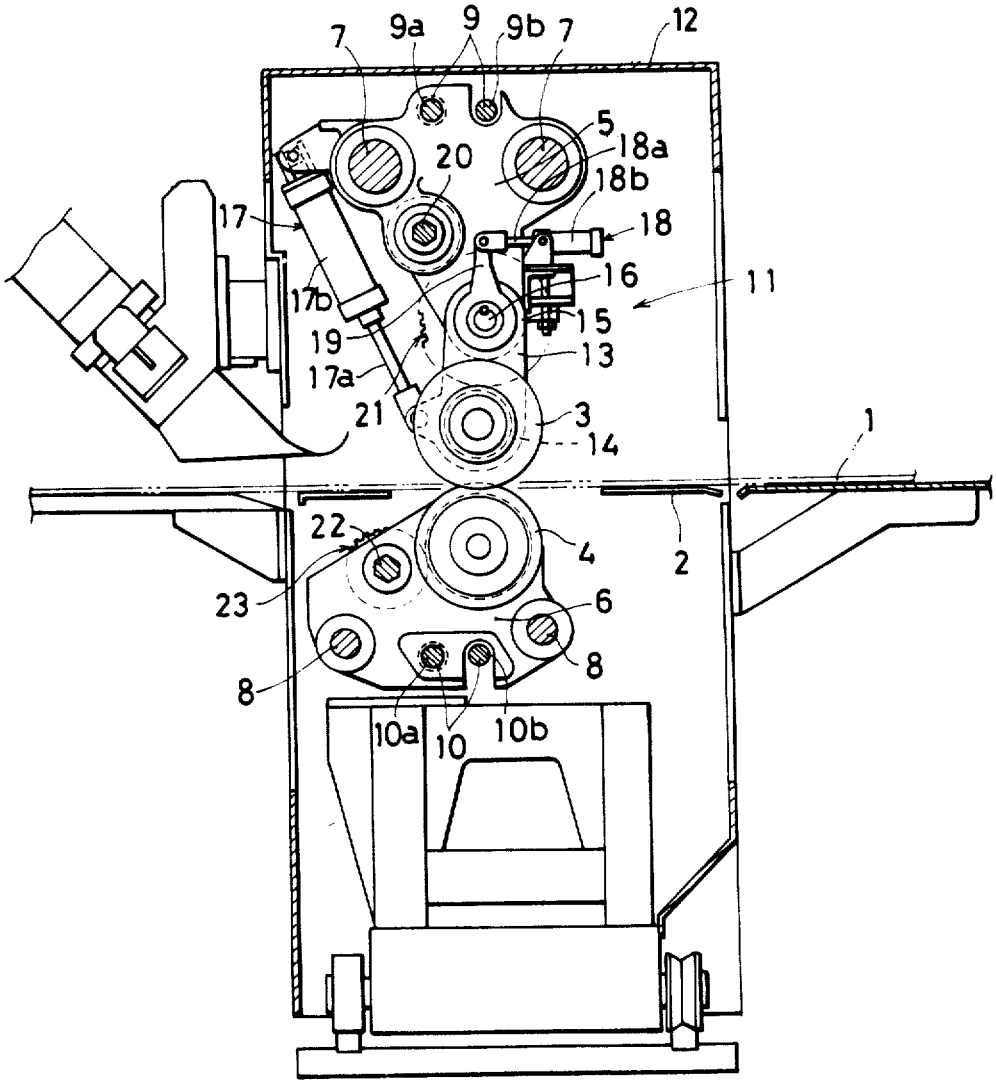
FIG. 2 is an enlarged sectional view taken along the line II—II in FIG. 1.

Additionally, in the illustrated example, as shown clearly in FIGS. 2 and 3, each assembly 11 is of the type that the upper rotary cutter 3, is provided on the upper shifter 5 through a supporting arm 13, and the lower rotary cutter 4 is provided directly on the lower shifter 6.

In more detail, the rotary cutter 3 is rotatably supported on a lower end portion 14 of the supporting arm 13. An upper end portion 15 of the supporting arm 13 is in threaded engagement with a screw rod 16 which is provided on the upper shifter 5 so as to extend in parallel with the guide rods 7, so that the supporting arm 13 may be swingable about the screw rod 16 and at the same time may be movable along the axial direction of the screw rod 16. Additionally, the upper shifter 5 is provided with a first driving means 17 for swinging the supporting arm 13 and a second driving means 18 for turning the screw rod 16. The first driving means 17 comprises an air cylinder means with a piston rod 17*a* thereof being pivotally attached to the lower end portion 14 of the supporting arm 13, and a cylinder 17*b* thereof being attached through a universal joint means to the upper shifter 5. The second driving means 18 comprises an air cylinder means with a piston rod 18*a* thereof being pivotally attached to a turning arm 19 extending from one end of the screw rod 16 and a cylinder 18*b* thereof being pivotally attached to the upper shifter 5.

Referring to the drawings, a driving shaft 20 is provided for rotating the upper rotary cutter 3. A gear train 21 is connected between the shaft 20 and the cutter 3. A driving shaft 22 rotates the lower rotary cutter 4, and a gear train 23 connects between the shaft 22 and the cutter 4.

The operation of the foregoing example of the present invention will be explained as follows. In order to provide a space distance between the upper and lower rotary cutters 3, 4 for any desired one of the left side assemblies 11, 11, 11 and for adjusting the width of the upper and lower rotary cutters 3, 4 of the corresponding opposite one of the right side assemblies 11, 11, 11, the rotary cutters 3, 4 of the left side assembly 11, for instance, are shifted through the corresponding shifters 5, 6. Prior to this shift movement, out of the two rotary cutters 3, 4 which are mutually laterally in overlapped relationship, as shown in FIG. 2 and FIG. 3, the upper rotary cutter 3 is separated upwards from the lower rotary cutter 4 by swinging the supporting arm 13 upwards by the operation of the first driving means 17. During this operation, the supporting arm 13 which is being swung upwards is, at the same time, guided by the threads of the screw rod 16 to be moved laterally along the axial direction of the screw rod 16. During this movement, it is preferable that the lateral moving direction thereof is such that the upwardly swinging upper rotary cutter 3 moves away from the lower rotary cutter 4. In this manner, the opportunity of the two rotary cutters 3, 4 being brought into abutment one with another and being damaged during the time when the upper rotary cutter 3 is being swung upwards from the lower rotary cutter 4 by the swing movement of the supporting arm 13 is surely avoided.

Thereafter, the upper and lower shifters 5, 6 are moved to predetermined positions by means of the respective feeding screws 9, 10. Finally, the supporting arm 13 is swung downwardly by the driving means 17 and in conjunction therewith the upper rotary cutter 3 is moved downwardly to a position at which the same is slightly laterally overlapped with the lower rotary cutter 4. During this operation, the supporting arm 13, which is being swung downwardly, is moved laterally along the thread of the screw rod 16 by the guidance of the same. During this movement, it is preferable that the lateral moving direction thereof is such that the downwardly swinging upper rotary cutter 3 comes nearer to the lower rotary cutter 4.

In a situation where the lateral gap between the upper and lower rotary cutters 3, 4 is not proper, that is, not a predetermined shearing gap, the screw rod 16 is turned through the turning arm 19 by the secondary driving means 18 so that the supporting arm 13 is slightly moved laterally along the screw rod 16 for finely adjusting the gap between the upper and lower rotary cutters 3, 4.

In the foregoing example, an apparatus has been explained wherein only the upper rotary cutter 3 is swingable through the supporting arm 13. However, the apparatus may be modified into a type wherein the lower rotary cutter 4 is also swingable.

Additionally, in the foregoing example, an arrangement has been explained wherein the upper and lower rotary cutters 3, 4 are provided on the upper and lower shifters 5, 6. However, a modification can be considered wherein the rotary cutters 3, 4 are provided on respective carries provided separated from the respective shifters 5, 6.

Thus, according to the present invention, at least either one of a pair of upper and lower rotary cutters is rotatably provided on one end portion of a supporting arm, and the other end portion of the supporting arm is in threaded engagement with a screw rod provided in parallel with a guide rod so that the supporting arm may be swingable about the screw rod and at the same time be movable along the axial direction of the screw rod. Additionally, a first driving means for swinging the supporting arm and a second driving means for turning the screw rod are provided so that the two rotary cutters can be separated one from another in the upper and lower directions so as to be shifted under separate movements. Further, the two rotary cutters at the predetermined shifted positions can be brought into the laterally overlapped condition by swinging of the supporting arm. Lastly, the gap between the two rotary cutters can be finally adjusted in the manner the screw rod is turned by the second driving means and in conjunction therewith the supporting arm is moved laterally along the turning screw rod, so that the fine adjustment of the gap between the two rotary cutters can be carried out easily and for a short time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A slitter apparatus for slitting a sheet member such as a corrugated cardboard or the like into predetermined widths comprising:

at least one pair of upper and lower rotary cutters and at least one pair of upper and lower shifters corresponding thereto being disposed above and below a conveying passage for the sheet member;

a pair of guide rods;

said pair of upper and lower shifters being operatively arranged to be moved slidably along on said respective guide rods by means of respective feeding screws;

said pair of upper and lower rotary cutters being selectively imparted with a predetermined shift movement;

at least one of the upper and lower rotary cutters being rotatably supported on one end portion of a supporting arm, and the other end portion of the supporting arm being in threaded engagement with a screw rod provided in parallel with the guide rods so that the supporting arm may be swingable about the screw rod and also may be movable along the axial direction of the turning screw rod;

a first driving means being operatively mounted for swinging the supporting arm; and a second driving means being operatively mounted for turning the screw rod.

2. The apparatus of claim 1, wherein the first driving means comprises an air cylinder means including a cylinder and a piston rod, either one of said cylinder and said piston rod thereof being connected to the one end portion of the supporting arm and the other thereof being connected to the shifter.

3. The apparatus of claim 1, wherein the second driving means comprises an air cylinder means including a cylinder and a piston rod, either one of said cylinder and piston rod thereof being connected to a turning arm extending from one end of the screw rod and the other thereof being connected to the shifter.

* * * * *